US005615960A

United States Patent [19]

Mori et al.

[11] Patent Number: 5,615,960

[45] Date of Patent: Apr. 1, 1997

[54] TAPE PRINTING APPARATUS HAVING A SLOT FOR INSERTION OF A TAPE CASSETTE

[75] Inventors: Masahiko Mori; Yasuhiko Iwane, both of Iwate-ken, Japan

[73] Assignee: Alps Electric Co., Ltd., Tokyo, Japan

[21] Appl. No.: 580,269

[22] Filed: Dec. 28, 1995

[30] Foreign Application Priority Data

Dec. 28, 1994 [JP] Japan ..... 6-328087

[51] Int. Cl.[6] ..... B41J 11/56

[52] U.S. Cl. ..... 400/613; 400/615.2; 400/586; 400/120.17

[58] Field of Search ..... 400/613, 615.2, 400/586, 207, 208, 208.1, 660, 660.1, 660.2, 660.3, 120.16, 120.17

[56] References Cited

U.S. PATENT DOCUMENTS 5,022,771 6/1991 Paque ..... 400/613
5,253,334 10/1983 Kimura et al. ..... 400/586
5,374,132 12/1994 Kimura ..... 400/613
5,435,657 7/1995 Pearce et al. ..... 400/586

*Primary Examiner*—John S. Hilten
*Attorney, Agent, or Firm*—Guy W. Shoup; Patrick T. Bever

[57] ABSTRACT

A thin tape printing apparatus is provided which requires less operation space when a tape cassette is loaded and unloaded and is suitable for integration into a variety of apparatuses. The tape printing apparatus includes a cassette insertion slot provided on the front side of a main unit, a cassette loading section which is connected to the cassette insertion slot so that a tape cassette having at least a platen roller and a platen drive gear for rotating the platen roller can be loaded and unloaded from the side of the main unit, a print head for performing printing on a tape-shaped recording medium, and a drive motor for driving the platen roller via the platen drive gear.

9 Claims, 7 Drawing Sheets

TAPE PRINTING APPARATUS HAVING A SLOT FOR INSERTION OF A TAPE CASSETTE

BACKGROUND OF THE INVENTION

1. Field of the Invention

The present invention relates to a tape printing apparatus for printing relatively simple characters, figures or symbols on a recording medium in the form of a tape, such as a label.

2. Description of the Related Art

In recent years, tape printing apparatuses have been proposed which are capable of printing relatively simple characters, such as names, figures or symbols on heat-sensitive paper or a tape-shaped recording medium called a label formed of a resin film or the like, and have come to be widely used.

Such conventional tape printing apparatus, as disclosed in, for example, Japanese Patent Laid-Open No. 5-185707, comprises an operation section in which are provided character input keys for inputting characters, figures or symbols, the print key, and various function keys, a display section formed of a liquid-crystal element or the like for displaying input characters or the like, and a cassette loading section for loading a tape cassette having a tape-shaped recording medium housed therein. The tape printing apparatus is adapted to make the print head, such as a thermal head, perform printing on a recording medium on the basis of the input print data while the tape-shaped recording medium is being transported.

The tape-shaped recording medium which has been completely printed is transported outside the tape printing apparatus, and is cut by an operator. Thus, a recording medium on which desired characters, figures or symbols are printed is obtained. The tape-shaped recording medium which is completely printed and cut is pasted on the reverse or obverse surface of a video cassette so as to be used as an index or the like of the video cassette.

The tape-shaped recording medium for use in such a tape printing apparatus, when the recording medium is heat-sensitive paper, is loaded inside the case by itself and formed into a tape cassette; when the recording medium is a resin film or the like, which does not develop color by itself, it is loaded inside the case together with an ink ribbon and formed into a tape cassette, and is fed out from the tape cassette to the length which is to be used and printed. This tape cassette is loaded in the cassette loading section provided in the printing section of the tape printing apparatus. Loading and unloading of the tape cassette from the tape printing apparatus are performed with the cover of the cassette housing section provided on the surface (top surface) of the tape printing apparatus being opened.

However, in the above-described conventional tape printing apparatus, use by itself is presupposed, and loading and unloading of the tape cassette from the tape printing apparatus are performed with the cover of the cassette loading section being opened. Therefore, the loading and unloading of the tape cassette from the tape printing apparatus must be performed in a place where space is available for opening the cover. In a state in which the tape printing apparatus is housed inside, for example, a rack, an operation space for opening and closing the cover cannot be taken up, and, as a result, the tape cassette cannot be loaded or unload from the tape printing apparatus.

In recent years, the following usage is increasing: a title showing the contents recorded on a video tape are written on a tape-shaped recording medium by using a tape printing apparatus, and this printed recording medium is pasted on the video cassette, and there have been demands for a construction in which the tape printing apparatus is integrated into a video cassette tape recorder (VTR).

However, as described above, the cover must be opened to load and unload the tape cassette from the tape printing apparatus. When the tape printing apparatus is mounted (integrated) into the VTR which is used housed inside a rack or the like, the tape printing apparatus cannot be disposed on the top surface of the VTR. Therefore, if the tape printing apparatus is disposed on the upright front side of the VTR, and the cover is opened or closed in front of the VTR, the mounting area of the tape printing apparatus with respect to the front side of the VTR becomes large, and the height of the VTR increases, and thus the VTR itself becomes enlarged.

Accordingly, there have been demands for a thin tape printing apparatus which takes up less operation space during loading and unloading of the tape cassette and is suitable for integration into a great variety of apparatuses.

SUMMARY OF THE INVENTION

It is an object of the present invention to provide a thin tape printing apparatus which takes up less operation space during loading and unloading of the tape cassette and is suitable for integration into a great variety of apparatuses.

It is another object of the present invention to provide a tape printing apparatus, in which a tape cassette having a tape-shaped recording medium housed therein is loaded in a main unit, for performing printing on the tape-shaped recording medium by a print head, the tape printing apparatus comprising: a cassette insertion slot provided on the front side of the main unit; a cassette loading section which is connected to the cassette insertion slot so that a tape cassette having at least a platen roller and a platen drive gear for rotating the platen roller can be loaded and unloaded from the main unit; a print head for performing printing on the tape-shaped recording medium; and a drive motor for driving the platen roller via the platen drive gear.

It is still another object of the present invention to provide a tape printing apparatus comprising a head drive mechanism which operates in linkage with the operation of loading the tape cassette into the cassette loading section so that the print head is brought into contact with the platen roller of the tape cassette via the tape-shaped recording medium.

it is yet still another object of the present invention to provide a tape printing apparatus comprising a driving force transmission mechanism which, when the tape cassette is loaded into the cassette loading section, is connected to the platen drive gear of the tape cassette and is capable of transmitting the driving force of the drive motor to the platen drive gear.

In accordance with one aspect of the present invention, since the tape cassette can be loaded from the side of the tape cassette apparatus via a cassette insertion slot provided on the front of the tape printing apparatus, it is possible to form the tape printing apparatus to be thin such that the height of the front side of the tape printing apparatus during loading and unloading is low, and the tape cassette can be loaded and unloaded at a small operation space.

In accordance with another aspect of the present invention, the head drive mechanism is driven only by loading the tape cassette into the cassette loading section, and the print head can be brought into contact with a platen roller of the tape cassette via a tape-shaped recording medium.

In accordance with still another aspect of the present invention, the loading of the tape cassette into the cassette loading section causes the driving force transmission mechanism to be connected to the platen drive gear for rotating the platen roller, and thereby the driving force of the drive motor can be transmitted to the platen roller.

The above and further objects, aspects and novel features of the invention will become more apparent from the following detailed description when read in connection with the accompanying drawings.

DETAILED DESCRIPTION OF THE PREFERRED EMBODIMENT

A preferred embodiment of the present invention will be described below with reference to the accompanying drawings.

The schematic construction of a tape printing apparatus of the present invention will be described first with reference to FIG. 1.

Figure 1:
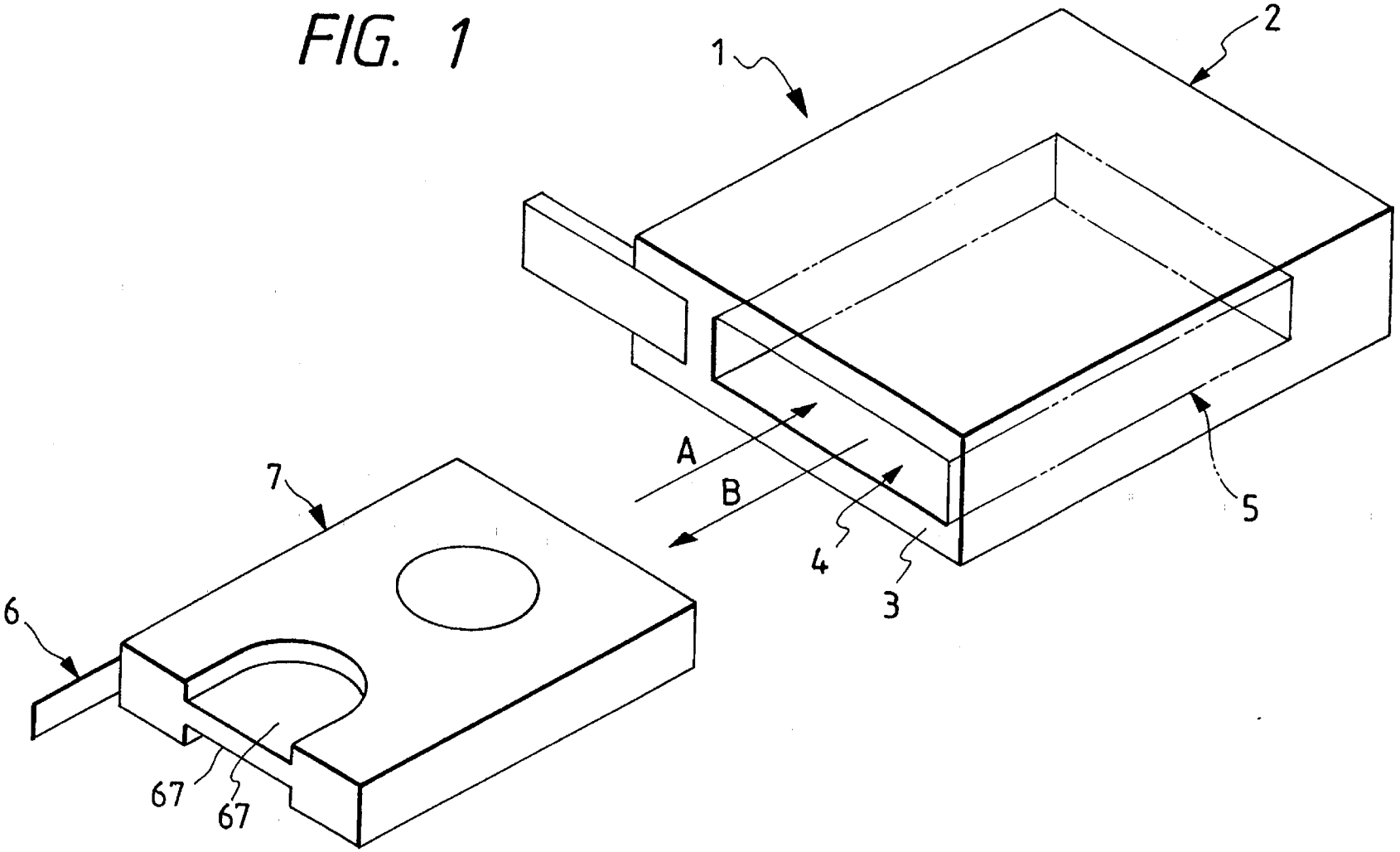
FIG. 1 is a perspective view illustrating the entire construction of an embodiment of a tape printing apparatus in accordance with the present invention.

FIG. 1 is a perspective view illustrating the entire construction of an embodiment of a tape printing apparatus in accordance with the present invention.

As shown in FIG. 1, a tape printing apparatus 1 of this embodiment has a main unit 2 formed in a box shape. One side (shown in the left front portion in FIG. 1) from among the sides of the main unit 2 is made to be a front side 3 serving as an operation side. A cassette insertion slot 4 having a rectangular front side is opened with the longitudinal direction thereof being in parallel to the longitudinal direction of the front side 3 of the main unit 2. A cassette loading section 5 indicated by the imaginary lines in FIG. 1 is provided so as to connect to the cassette insertion slot 4.

A tape cassette 7 having a tape-shaped recording medium 6 housed therein (one end of the tape-shaped recording medium 6 can be guided outside), as shown by the arrows A and B in FIG. 1, can be loaded into the cassette loading section 5 via the cassette insertion slot 4 formed on the front side 3 of the main unit 2. That is, in the tape printing apparatus 1 of this embodiment, the tape cassette 7 can be loaded and unloaded from the front side 3 of the main unit 2. In FIG. 1, arrow A indicates the direction in which the tape cassette 7 is loaded, and arrow B indicates the direction in which the tape cassette 7 is unloaded.

The tape printing apparatus 1 in this embodiment is mounted in a video cassette tape recorder (VTR) 72, which will be described later, and used.

Next, the tape printing apparatus of this embodiment will be described in more detail with reference to FIGS. 2 to 5.

Figure 2:
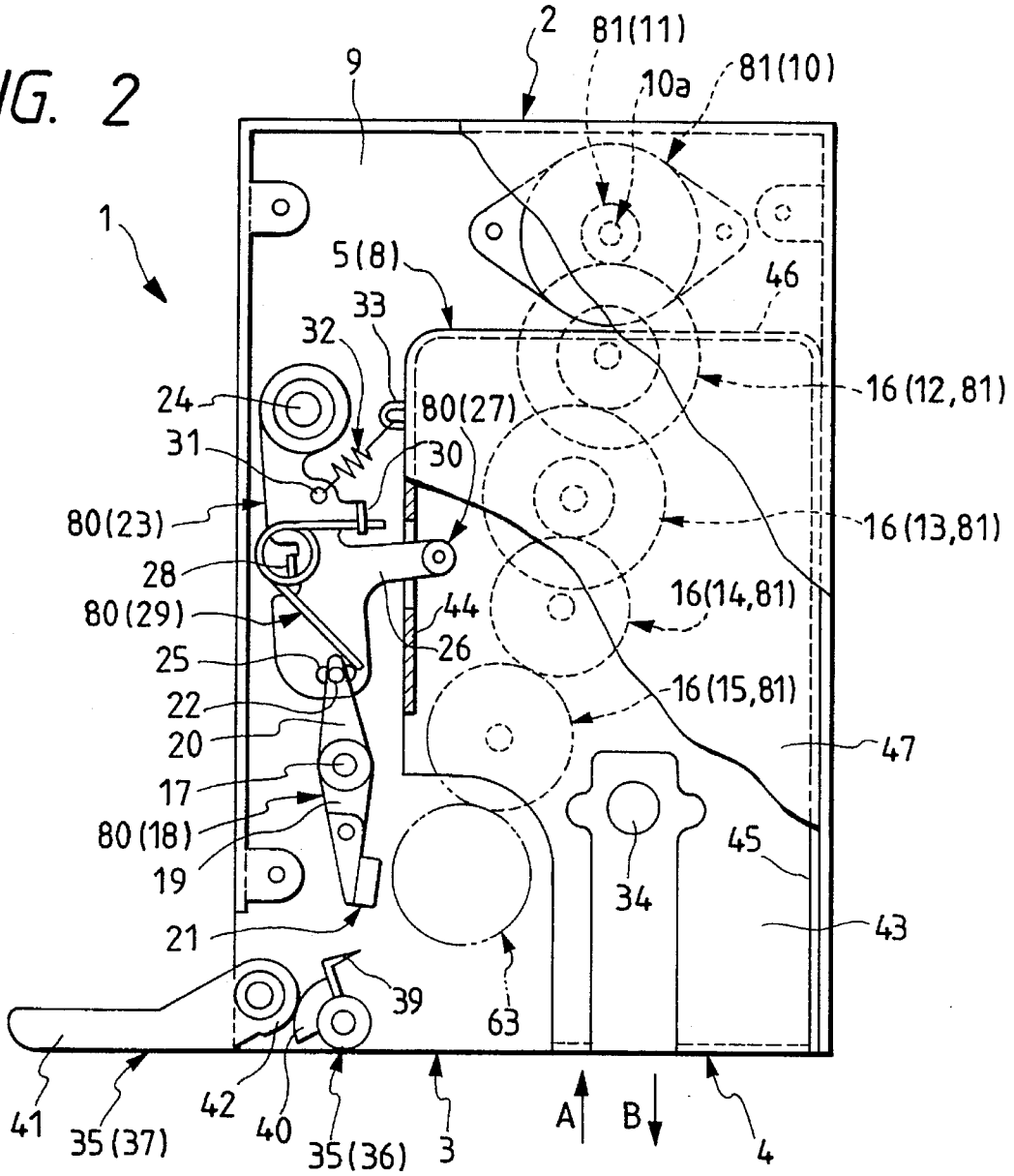
FIG. 2 is a partly cutaway, plan view illustrating the essential portion of the embodiment of the tape printing apparatus in accordance with the present invention.
Figure 3:
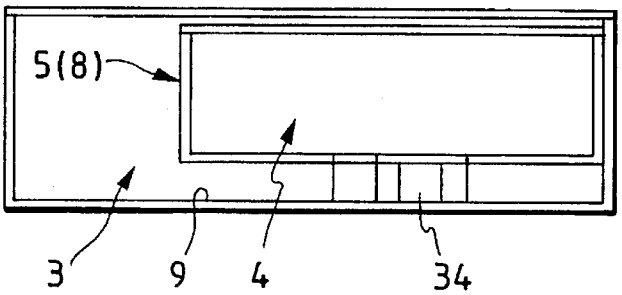
FIG. 3 is a front view of the essential portion in which a part of FIG. 2 is omitted.
Figure 4:
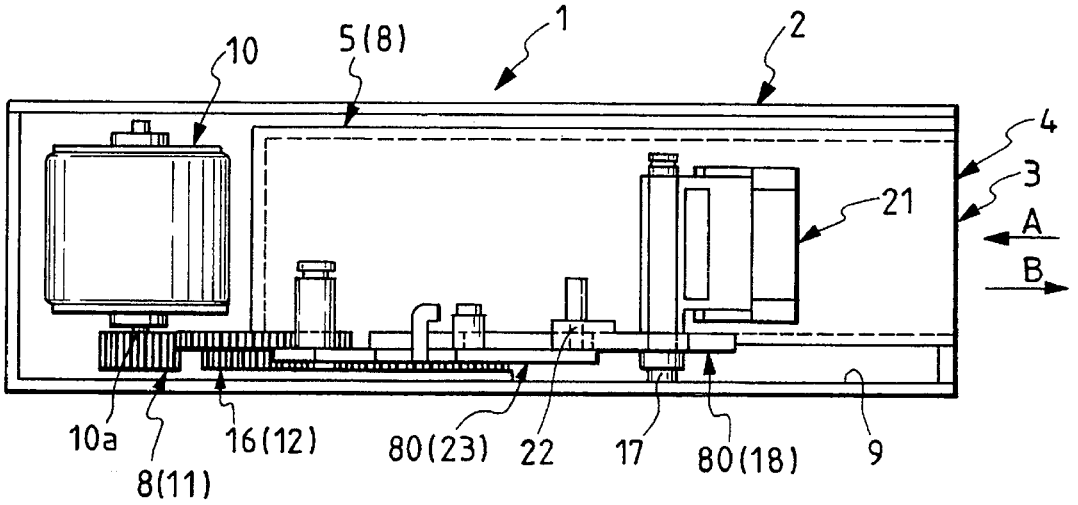
FIG. 4 is a left side view illustrating the interior of the essential portion in which a part of FIG. 2 is omitted.

As shown in FIGS. 2 to 4, the tape printing apparatus 1 of this embodiment has a main unit 2 which is formed into a pair of upper and lower parts, has a nearly rectangular plane, and is formed in a nearly box shape as the whole. One side (shown in the lower portion of FIG. 2) from among the sides of the main unit 2 is made into the front side 3 which serves as the operation side, and the cassette insertion slot 4 is provided on the front side 3. The cassette insertion slot 4, as shown in FIG. 3, is formed in a rectangular front shape, and is provided with the longitudinal direction thereof parallel to the longitudinal direction of the front side 3 of the main unit 2. Further, provided inside the main unit 2 is an inner case 8 which constitutes the cassette loading section 5 such that the front side 3 side is open in such a manner as to connect to the cassette insertion slot 4.

As shown in FIGS. 2 to 5, in the right rearward of a bottom surface 9 inside the main unit 2, a drive motor 10 is disposed with its output shaft 10*a* being directed downward, and a drive gear 11 is mounted in the output shaft 10*a* (FIG. 4). This drive gear 11 is connected (fitted) to an input gear 12 formed of a two-step gear having two small and large gears which are positioned toward the front side 3 side from the drive gear 11 and rotatably supported on the bottom surface 9. This input gear 12 is connected (fitted) to a first intermediate gear 13 formed of a two-step gear having two small and large gears which are positioned toward the front side 3 side from the input gear 12 and rotatably supported on the bottom surface 9. Further, the first intermediate gear 13 is connected (fitted) to a second intermediate gear 14 which is positioned toward the front side 3 side from the first intermediate gear 13 and rotatably supported on the bottom surface 9. The second intermediate gear 14 is connected (fitted) to an output gear 15 which is positioned toward the front side 3 side from the second intermediate gear 14 and rotatably supported on the bottom surface 9. Each of the gears 12, 13, 14, and 15 connected to the drive gear 11 is disposed in substantially a line toward the front side 3 side on the bottom surface 9, and the driving force of the drive motor 10 can be transmitted in sequence. The output gear 15 can be connected to a platen drive gear 63, which will be described later, disposed in the tape cassette 7 in a state in which the cassette is loaded.

The input gear 12, the first intermediate gear 13, the second intermediate gear 14, and the output gear 15 described above constitute a driving force transmission mechanism 16 of this embodiment.

The above-described drive motor 10, the driving force transmission mechanism 16, a platen roller 60 to be described later disposed in the tape cassette 7, and the platen drive gear 63 constitute a tape movement mechanism 81 of this embodiment.

Disposed to the left of the output gear 15 is a head lever 18 such that its longitudinal, nearly central portion is rotatably supported by a support shaft 17 which is disposed vertically on the bottom surface 9. This head lever 18 is formed in a nearly plate shape, and is disposed so as to extend substantially parallel to the bottom surface 9. The head lever 18 has a front arm 19 positioned on the front side 3 side of the main unit 2, and a back arm 20 positioned in the rearward of the main unit 2 with the support shaft 17 as the center. The head lever 18 is disposed with its longitudinal direction in a back and forth direction (shown in the up and down direction in FIG. 2), and is made to be rotatable with the support shaft 17 as the center.

Disposed on the top surface on the free end side of the front arm 19 of the head lever 18 is a thermal head 21 serving as a print head having a plurality of heat generating elements (not shown) arrayed thereon. The thermal head 21, by the rotational movement of the head lever 18 with the support shaft 17 as the center, is adapted to contact and separate from the the outer peripheral surface of the platen roller 60 to be described later disposed in the tape cassette 7 via the tape-shaped recording medium 6 in a state in which a cassette is loaded. An engagement pin 22 is vertically provided toward the bottom surface 9 on the bottom surface near the free end of the back arm 20 of the head lever 18.

Figure 5:
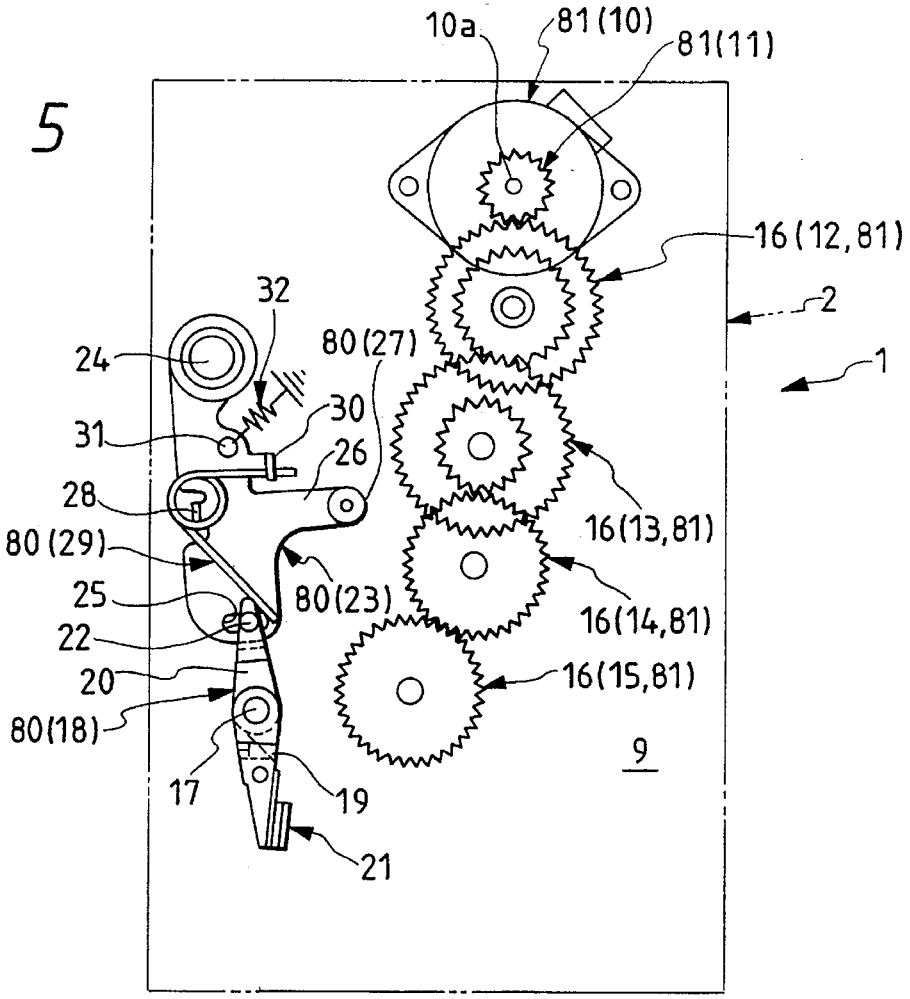
FIG. 5 is a plan view illustrating the interior of the essential portion in which a part of the embodiment of the tape printing apparatus of the present invention is omitted.

As shown in FIGS. 2 and 5, a plate-shaped head lever drive arm 23 is disposed in the rearward of the head lever 18, which head lever drive arm makes the thermal head 21 mounted in the head lever 18 contact or separate from the platen roller 60 to be described later disposed in the tape cassette 7 in a state in which a cassette is loaded. The base end portion of the head lever drive arm 23 is rotatably supported by a rotational support shaft 24 which extends in substantially parallel to the bottom surface 9 and is vertically disposed in the left rearward of the bottom surface 9, and the free end of the head lever drive arm 23 is positioned below the free end of the back arm 20 of the head lever 18.

The pin 22 which is vertically provided on the bottom surface on the free end side of the back arm 20 of the head lever 18 is fitted, and a substantially arc slot 25 for limiting the rotational movement range of the head lever 18 with the support shaft 17 as the center is formed near the free end of the head lever drive arm 23. A subarm 26 which extends to the right in FIGS. 2 and 5 is formed in the substantially central portion of the head lever drive arm 23 along the length thereof, and a rotatable cam follower 27 in the shape of a roller is disposed on the top surface in the front end portion of the subarm 26. This cam follower 27 comes into contact with a cam surface 65, to be described later, of the tape cassette 7, and is able to make the head lever drive arm 23 move rotationally in a clockwise direction in FIGS. 2 and 5 with the rotational support shaft 24 as the center in a state in which the cassette is loaded. A spring support part 28 is vertically provided on the left top surface in a substantially central portion of the head lever drive arm 23 along the length thereof, and a torsional coil spring 29 is locked in such a manner as to be in contact with the the front edge of the spring support part 28 and locked thereto.

One end of the torsional coil spring 29 (shown in the lower portion in FIGS. 2 and 5) is locked in such a manner as to be in contact with the right surface in the front end portion of the back arm 20 of the head lever 18 so as to make it possible to urge the head lever 18 in a clockwise direction. The other end of the torsional coil spring 29 (shown in the upper portion in FIGS. 2 and 5) is locked in such a manner as to be in contact with the front edge of an engagement projection 30 which is vertically provided in the rearward of the main unit 2 from the base end portion of the subarm 26 of the head lever drive arm 23.

A through hole 31 which goes through along the plate thickness is formed near the base end portion of the head lever drive arm 23, as shown in FIGS. 2 and 5, and one end of an urging spring 32 for always urging the head lever drive arm 23 in a counterclockwise direction in FIGS. 2 and 5 with the rotational support shaft 24 as the center is locked to the through hole 31. The other end of the urging spring 32 is locked to a spring engagement member 33 (FIG. 2) disposed on the bottom surface 9.

The head lever 18, the head lever drive arm 23, the cam follower 27, and the torsional coil spring 29 described above constitute a head drive mechanism 80 of this embodiment.

More specifically, in this embodiment, when the cam follower 27 is moved to the left in FIGS. 2 and 5, the head lever drive arm 23 makes the rotational support shaft 24 rotate in a clockwise direction with the rotational support shaft 24 as the center. As the head lever drive arm 23 rotates in a clockwise direction, one end (shown in the lower portion in FIGS. 2 and 5) of the torsional coil spring 29 causes the front end (free end) of the back arm 20 of the head lever 18 move to the left in FIGS. 2 and 5. As a result, the spring force of the torsional coil spring 29 makes it possible to make the head lever 18 rotate in a clockwise direction in FIGS. 2 and 5 with the support shaft 17 as the center.

As shown in FIG. 2, vertically provided to the right of the output gear 15 is an engagement projection 34 in a substantially columnar shape used to position the tape cassette 7 in place in a state in which the cassette is loaded. Disposed near the left end portion of the front side 3 side of the bottom surface 9 is a tape cutting mechanism 35 for cutting the tape-shaped recording medium 6 to a desired length.

As shown in FIG. 2, the tape cutting mechanism 35 has a cutting base member 36 and a cutter lever 37 for operating the cutting base member 36. The cutting base member 36 has a base part 38 having a substantially circular plane which is rotatably supported on the bottom surface 9. Provided on the outer peripheral surface of the base part 38 is a cutting edge 39 for cutting the tape-shaped recording medium 6 in a direction substantially at right angles to the longitudinal direction so as to face an edge receiving part 66 to be described later disposed on the side of the tape cassette 7 in a state in which the cassette is loaded. The outer peripheral surface of the base part 38 is disposed at a position spaced apart from the side of the tape cassette 7 in a state in which the cassette is loaded so as not to obstruct the movement of the printed tape-shaped recording medium 6 which is fed from the tape cassette 7. Further, a cutter drive gear 40 formed in a substantially fan shape is mounted coaxially with the base part 38 in the end surface of the base part 38 facing the bottom surface 9.

The cutter lever 37 is rotatably supported in the left end on the front side of the bottom surface 9 of the main unit 2. The cutter lever 37 is formed with an operation arm 41 which extends outside the main unit 2 and which is manually operated, and a gear section 42 which engages the cutter drive gear 40.

That is, in this embodiment, by pulling the operation arm 41 of the cutter lever 37 toward the front side in FIG. 2 (rotated in a clockwise direction), the gear section 42 of the cutter lever 37 is rotated in a clockwise direction in FIG. 2, the cutter drive gear 40 connected to the gear section 42 is rotated in a clockwise direction in FIG. 2, the cutting edge 39 which is coaxially mounted in the cutter drive gear 40 is rotated in a clockwise direction in FIG. 2, and moved toward an edge receiving section 66 provided on the side of the tape cassette 7, and the tape cassette 7 can be cut to a desired length in a state in which the cassette is loaded.

Disposed above the driving force transmission mechanism 16 is the inner case 8 serving as the cassette loading section 5 formed in a case shape such that the front side 3 side is open in such a manner as to be connected to the cassette insertion slot 4. The inner case 8 is supported on the bottom surface 9 by means of a plurality of support ribs (not shown) which are vertically provided on the bottom surface 9 in such a manner as not to interfere the operation of each of the above-described sections. The inner case 8 comprises a bottom plate 43 for supporting and guiding the bottom surface of the tape cassette 7 in a state in which the cassette is loaded, a left-side plate 44 and a right-side plate 45 for positioning and guiding the left and right sides of the tape cassette 7 in a state in which the cassette is loaded, a rearward plate 46, and a top plate 47. Desired places of each of the above-described plates 43, 44, 45, 46, and 47 are opened so as not to interfere with the operation of each section disposed on the bottom surface 9 of the main unit 2, and the operation of each of the sections of the tape cassette 7, which operations will be described later.

For the top plate 47 and the right-side plate 45 which constitute the inner case 8 serving as the cassette loading section 5, the top surface and the right side of the main unit 2 may be used, and the top plate 47 and the right-side plate 45 are not particularly limited to the construction of this embodiment. Further, the inner case 8 may be mounted on the top surface of the main unit 2, and as long as the inner case 8 is of a construction in which the operation of each section disposed on the bottom surface 9 inside the main unit 2 is not interfered with, the case is not limited to the construction of this embodiment.

In this embodiment, an operation section 48 for manually inputting print information (not shown), a print information storage section 50 for storing print information, a print control section 51 for selectively heating the heat-generating elements disposed in the thermal head 21 and controlling the drive motor 10 on the basis of the print information, a display section 49 for displaying print information and the like are disposed in the VTR 72 (which will be described later) having mounted therein the tape printing apparatus 1 of this embodiment. The print control section 51 consists of a CPU (not shown), a memory and the like.

Figure 6:
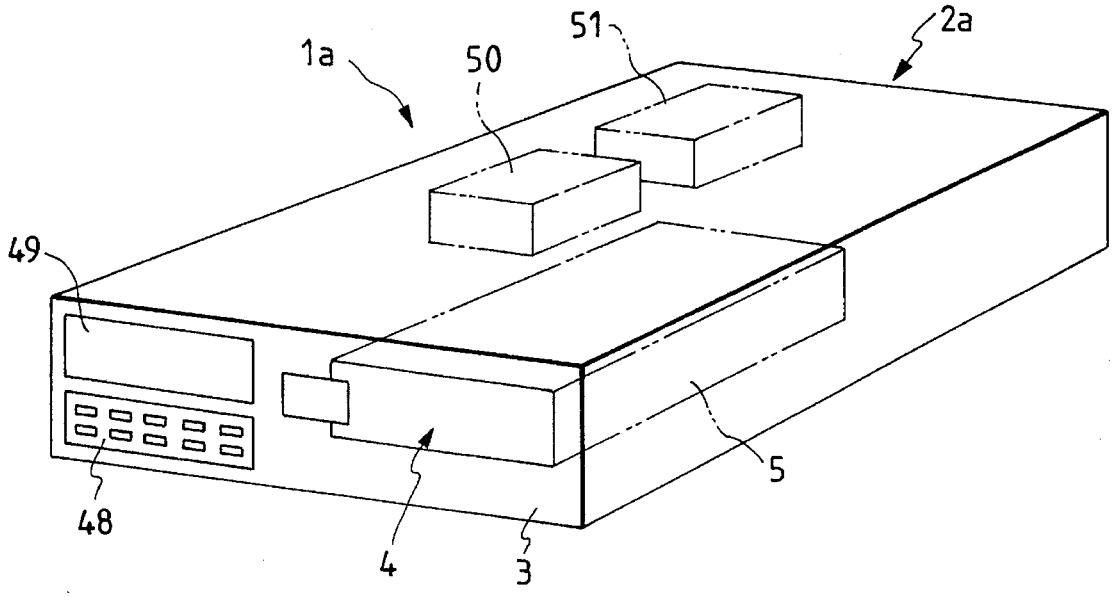
FIG. 6 is a perspective view illustrating the entire construction of another embodiment of a tape printing apparatus in accordance with the present invention.

FIG. 6 shows a modification of the tape printing apparatus 1 of this embodiment, illustrating a case in which a tape printing apparatus la of this embodiment can be used by itself. As shown in FIG. 6, the operation section 48 for manually inputting print information to the tape printing apparatus 1*a*, the display section 49 for displaying print information, which section is formed of liquid-crystal elements or the like for displaying input characters or the like, are disposed on the front side 3 of a main unit 2*a*. As indicated by the imaginary lines in FIG. 6, disposed inside the main unit 2*a* are the print information storage section 50 for storing print information for the tape printing apparatus, and the print control section 51 for selectively heating the heat-generating elements disposed in the thermal head 9 and controlling the drive motor 10 on the basis of the print information. The other construction is the same as that of the tape printing apparatus 1 of the above-described embodiment.

When the tape printing apparatus 1 is to be integrated with another apparatus, such as a VTR, a main unit of the other apparatus may serve as the main unit 2 of the tape printing apparatus 1.

Next, a tape cassette for use in the tape printing apparatus of this embodiment will be described with reference to FIGS. 7 and 8.

Figure 7:
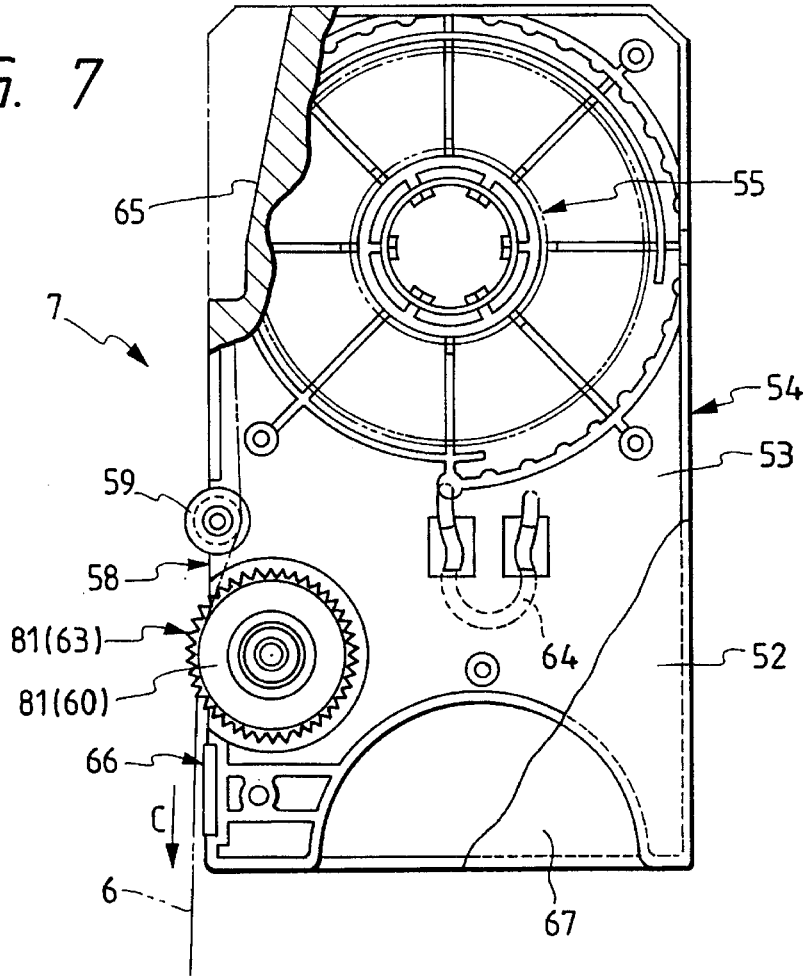
FIG. 7 is a plan view of the essential portion of the embodiment of a tape cassette for use in the tape printing apparatus of the present invention with a part of an upper lid case being removed.
Figure 8:
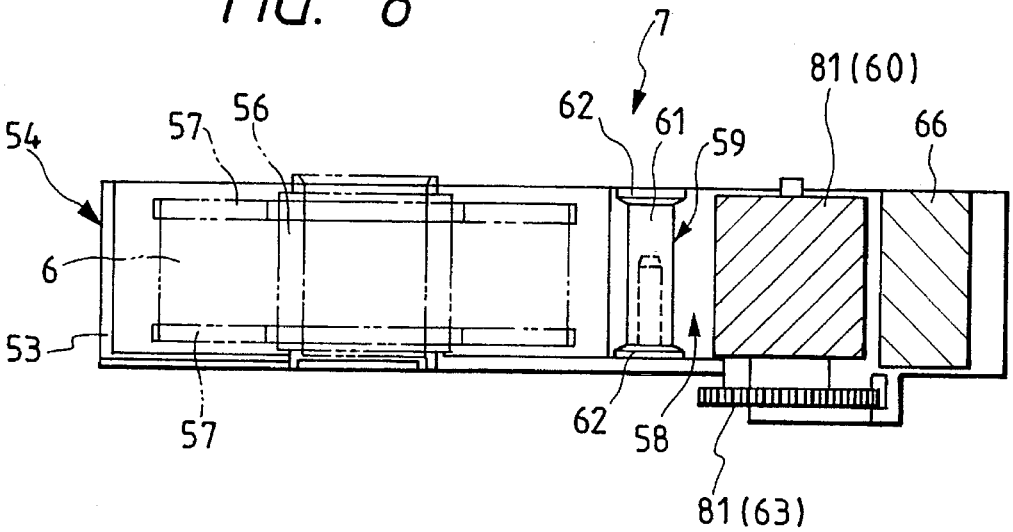
FIG. 8 is a left side view when the tape cassette of FIG. 7 is viewed from the platen roller side.

As shown in FIGS. 7 and 8, the tape cassette 7 of this embodiment has a cassette main unit 54 formed of a pair of upper and lower parts (an upper case 52 and a lower case 53) having a substantially rectangular plane. A tape reel 55 is rotatably supported inside the cassette main unit 54 shown in the upper portion in FIG. 7.

The tape reel 55, as shown in FIG. 8, has a mounting base portion 56 formed in a cylindrical shape. Near both ends of the outer peripheral surface of the mounting base portion 56, flange sections 57 having a circular plane which extend mutually in parallel are formed at right angles to the axis center of the mounting base portion 56. The tape-shaped recording medium 6 is wound around the outer peripheral surface of the mounting base portion 56 positioned between the flange sections 57.

Provided in the lower portion on the left side (shown in the left portion in FIG. 7) from among the sides of the cassette main unit 54 is a tape exit 58 for ejecting one end (free end) side of the tape-shaped recording medium 6 from inside the cassette main unit 54 toward the outside thereof.

A tape guide 59 for guiding the tape-shaped storage medium 7 is provided near one end of the tape exit 58 (shown in the upper portion in FIG. 7) along the length thereof, and disposed on the other end side (shown in the lower portion in FIG. 7) along the length thereof is the platen roller 60 which is rotatably supported in such a manner that a part of the outer peripheral surface of the platen roller 60 projects outside from the tape exit 58.

The tape guide 59, as shown in FIG. 8, has a base part 61 formed in a cylindrical shape. Flanges 62 which extend parallel to each other having a circular plane are formed at right angles to the axis center of the base part 61. The outer peripheral surface of the base part 61 positioned between the flanges 62 is brought into contact with the tape-shaped recording medium 6 and guides the tape-shaped recording medium 6. The tape guide 59 may be rotatably supported in the cassette main unit 54, and is not particularly limited to the construction of this embodiment. The tape guide 59 of this embodiment such that the distance between the flanges 62 is different can be changed as required depending upon the tape width of the tape-shaped recording medium 6. That is, changing of the tape guide 59 makes it possible to cope with a number of types of tape-shaped recording media 6 having different tape widths by one tape cassette 7.

The platen roller 60 is made to be a rubber roller such that at least the outer peripheral surface thereof is formed of a rubbery elastic member, such as rubber. In a state in which the cassette is loaded, the thermal head 21 of the tape printing apparatus 1 can be brought into contact with the platen roller 60 via the tape-shaped recording medium 6. The contact place between the thermal head 21 and the platen roller 60 is made to be the print position. Below the platen roller 60, the platen drive gear 63 for rotating the platen roller 60 is coaxially mounted in the platen roller 60 so as to rotate as one unit with the platen roller 60. The platen drive gear 63 can be connected (fitted) to the output gear 15 disposed in the tape printing apparatus 1.

One end (free end) of the tape-shaped recording medium 6 wound around the outer peripheral surface of the tape reel 55 is pulled outside from the tape exit 58 through the tape guide 59, and guided out along the direction of the tape movement indicated by the arrow C in FIG. 7 passing on the outer peripheral surface of the platen roller 60 which projects outside from the tape exit 58.

An elastic projection 64 formed in a substantially horseshoe shape is disposed on the bottom surface in the substantially central portion of the lower case 53 of the cassette main unit 54 so as to be exposed on the lower surface side of the cassette main unit 54. This projection 64 is fitted onto the outer peripheral surface of the engagement projection 34 of the tape printing apparatus 1 in a state in which the cassette is loaded, so that the tape cassette 7 loaded into the cassette loading section 5 is positioned in place, and tactile feedback is given such that the termination of the loading of the tape cassette 7 into the cassette loading section 5 is bodily sensed by the operator.

The cam surface 65 is recessed in the corner (shown in the upper left portion in FIG. 7) of the lower case 53 of the cassette main unit 54. This cam surface 65, serving as a drive source for operating the head drive mechanism 80, is formed in such a way that as the tape cassette 7 is pushed into the cassette loading section 5 of the tape printing apparatus 1, the cam follower 27 of the tape printing apparatus 1 is moved to the left in FIG. 2.

Provided near the lower end on the left-side surface (shown in the left portion in FIG. 7) from among the sides of the cassette main unit 54 is the cutting-edge receiving section 66 for receiving the cutting edge 39 of the tape cutting mechanism 35 so as to face the movement direction of the point of the cutting edge 39 when the tape is cut. The edge receiving section 66 may be formed of a hard rubber or the like, and mounted in the cassette main unit 54.

On the front side (shown in the lower portion in FIG. 7) of the top surface and the bottom surface of the cassette main unit 54, an operational recessed part 67 having a substantially circular plane shape which the operator grips by the fingers when the cassette is to be loaded is provided (see FIG. 1).

Next, a tape-shaped recording medium for use in a tape cassette in accordance with this embodiment will be described with reference to FIGS. 9 and 10.

Figure 9:
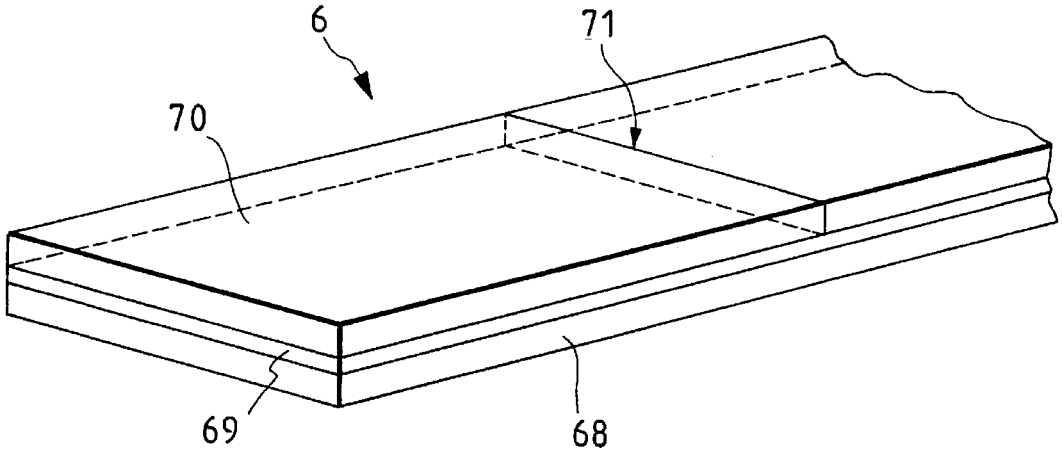
FIG. 9 is a perspective view illustrating the construction of an embodiment of a tape-shaped recording medium housed inside the tape cassette for use in the tape printing apparatus of the present invention.

As shown in FIG. 9, the tape-shaped recording medium 6 of this embodiment has an adhesive layer 69 formed of an appropriate adhesive formed on one of the surfaces of heat-sensitive paper 68 in a long length in the form of a continuous member which develops color when heat is supplied thereto, and releasing paper 70 is pasted on the surface of the adhesive layer 69.

The releasing paper 70 is formed with cut parts 71 of what is commonly called half cuts, which are cut at desired intervals narrower than the cut length, for example, the length to be pasted on the label paste portion of the video cassette.

That is, in the tape-shaped recording medium 6 of this embodiment, by bending it toward the heat-sensitive paper 68 side at the position of the cut part 71 of the releasing paper 70, the cut part 71 of the releasing paper 70 can be easily peeled off from the adhesive layer 69.

Figure 10:
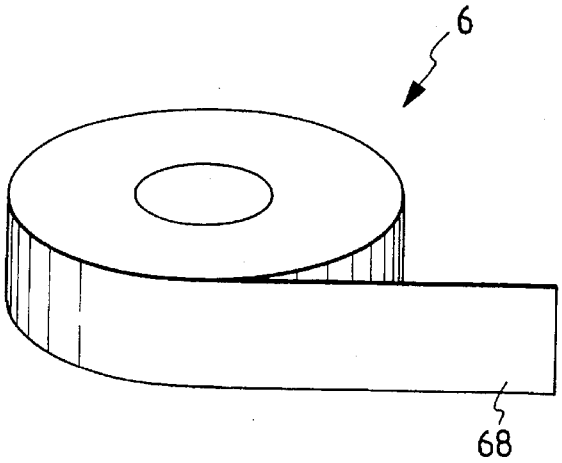
FIG. 10 is an illustration of the wound state of the tape-shaped recording medium housed inside the tape cassette for use in the tape printing apparatus of the present invention.

As shown in FIG. 10, the tape-shaped recording medium 6 is wound with the heat-sensitive paper 68 facing outward.

Since an end display part (not shown) having a message or an end mark for making the operator recognize that the end of the tape-shaped recording medium 6 is near is provided by printing on the surface of the heat-sensitive paper 68 on the inner peripheral side (the end portion of the tape reel) of the tape-shaped recording medium, in a case where the tape-shaped recording medium 6 is pulled out from the tape cassette 7, it is possible to easily make the operator recognize that the end of the tape-shaped recording medium 6 is near and to prevent the tape-shaped recording medium 6 from being running out in the middle of the printing operation.

Next, a VTR having mounted therein a tape printing apparatus of this embodiment will be described with reference to FIG. 11.

Figure 11:
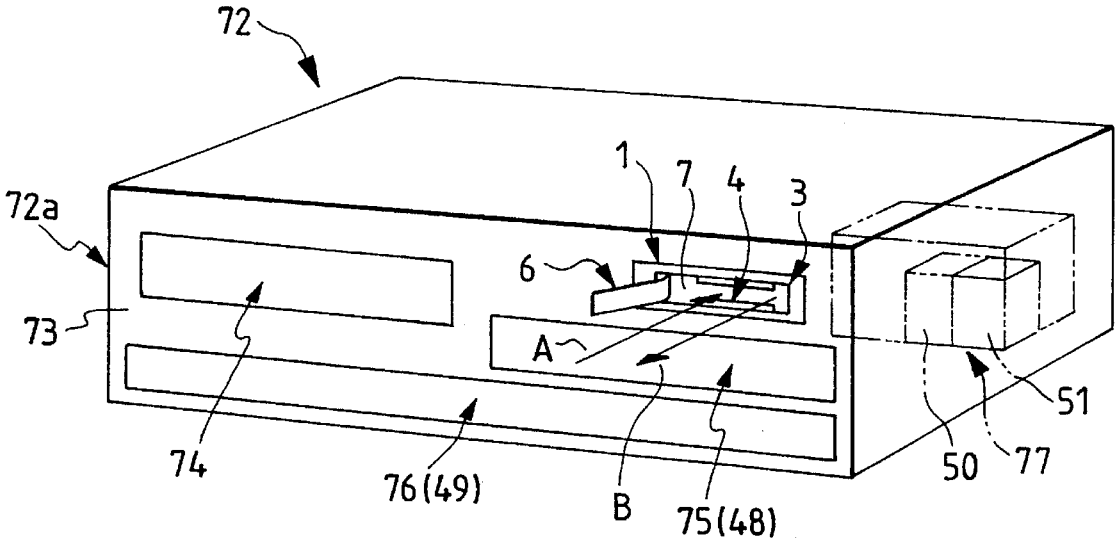
FIG. 11 is a perspective view illustrating the construction in a state in which a tape cassette of a VTR having mounted therein the tape printing apparatus of the present invention is loaded.

As shown in FIG. 11, in the VTR 72 of this embodiment, a video cassette insertion slot 74 from which a video cassette (not shown) is loaded into an upright front side 73 of the apparatus, which is the operation side of a main unit 72*a* of the apparatus, is provided. The tape printing apparatus 1 is disposed so as to be positioned to the right of the video cassette insertion slot 74. Disposed on the front side 73 of the apparatus are an operations section 75 which serves also as the operation section 48 for enabling print information to be manually input to the tape printing apparatus 1 and from which various operations are performed as a VTR, and a display section 76 which serves also as the display section 49 for displaying print information input to the tape printing apparatus 1 and displays the operating status of the VTR itself, time, and the like. As indicated by the imaginary lines in FIG. 11, disposed inside the VTR 72 are at least the print information storage section 50 for storing print information for the tape printing apparatus 1, the print control section 51 for selectively heating the heat generating elements arrayed in the thermal head and for controlling the drive motor 10 on the basis of the print information, and a control section 77 formed of a CPU (not shown) for controlling the VTR itself, memory, and the like.

Also, the VTR 72 of this embodiment receives information for the broadcast contents, such as a title, sent out at the same time as voice sound and video by using, for example, unused bands of television waves, and is able to immediately print the broadcast contents being recorded on the tape-shaped recording medium 6 by the tape printing apparatus 1 on the basis of this information.

Next, the operation of this embodiment constructed as described above will be described.

The operation of the tape printing apparatus of this embodiment will be described first with reference to FIGS. 1 to 12.

In the tape printing apparatus 1 of this embodiment, as indicated by the arrow A in FIG. 1, when the side of the tape cassette 7 is pushed manually into the cassette insertion slot 4 provided on the front side 3 of the tape printing apparatus 1 with the operational recessed part 67 of the tape cassette 7 being as the front side, the loading of the tape cassette 7 into the tape printing apparatus 1 is started. At this time, one end (free end) of the tape-shaped recording medium 6 housed inside the tape cassette 7, as indicated by the imaginary lines in FIG. 7, is pulled outside from the tape exit 58 via the tape guide 59, and passes on the outer peripheral surface of the platen roller 60 projecting outside from the tape exit 58.

When the tape cassette 7 is begun to be loaded, the tape cassette 7 is gradually pushed into the inner case 8 which is the cassette loading section 5 via the cassette insertion slot 4. At this time, the tape cassette 7 is guided while the side-to-side movements of the right and left sides of the tape cassette 7 are being restrained by the left-side plate 44 and the right-side plate 45 of the inner case 8, and the bottom surface of the tape cassette 7 is being supported on the bottom plate 43 of the inner case 8. Therefore, the tape cassette 7 can be surely pushed from the front side 3 of the tape printing apparatus 1 into the interior of the inner case 8 which is the cassette loading section 5 via the cassette insertion slot 4.

Next, as the loading (pushing in) of the tape cassette 7 into the interior of the inner case 8 proceeds, the cam surface 65 of the tape cassette 7 shown in FIG. 7 comes into contact with the cam follower 27 which constitutes a part of the head drive mechanism 80 disposed on the top surface of the end portion of the subarm 26 of the head lever drive arm 23 shown in FIG. 2, causing the cam follower 27 move gradually to the left in FIG. 2 as the loading of the tape cassette 7 proceeds further.

Then, as a result of the movement of the cam follower 27 to the left as the loading of the tape cassette 7 proceeds, the head lever drive arm 23 which constitutes a part of the head drive mechanism 80 is rotationally moved in a clockwise direction in FIGS. 2 and 5 with the rotational support shaft 24 as the center in opposition to the urging force of the urging spring 32 which is always urging the head lever drive arm 23 in a counterclockwise direction. In correlation with the rotational movement of the head lever drive arm 23 in a clockwise direction, the torsional coil spring 29 is rotationally moved in a clockwise direction in FIGS. 2 and 5, and one end (shown in the lower portion in FIGS. 2 and 5) of the torsional coil spring 29 causes the end of the back arm 20 of the head lever 18 to move to the left in FIGS. 2 and 5. As the end of the back arm 20 is moved to the left by the torsional coil spring 29, the head lever 18 is rotationally moved in a counterclockwise direction in FIGS. 2 and 5 with the support shaft 17 as the center, causing the thermal head 21 disposed on the top surface of the free end side of the front arm 19 of the head lever 18 to be brought into contact with the outer peripheral surface projecting outside from the tape exit 58 of the platen roller 60 disposed in the tape exit 58 of the tape cassette 7 shown in FIG. 7 via the tape-shaped recording medium 6.

That is, the head drive mechanism 80 operates, in correlation with the progress of the loading of the tape cassette 7, so that the thermal head 21 is brought into contact with the outer peripheral surface of the platen roller 60 via the tape-shaped recording medium 6 by the cam surface 65. The head drive mechanism 80, when the tape cassette 7 is to be unloaded from the cassette loading section 5, operates so as to make the thermal head 21 separated from the outer peripheral surface of the platen roller 60 by the urging force of the urging spring 32.

Since the thermal head 21 can be brought into contact with the platen roller 60 via the tape-shaped recording medium 6 with the urging force of the torsional coil spring 29, the press-contact force between the thermal head 21 and the platen roller 60 can always be maintained at a value appropriate for printing. Therefore, high print quality can always be obtained.

The loading of the tape cassette 7 terminates when the following occurs: the projection 64 provided so as to be exposed on the bottom surface side of the cassette main unit 54 of the tape cassette 7 engages the engagement projection 34 which is vertically provided on the bottom surface 9 of the main unit 2 of the tape printing apparatus 1, and the platen drive gear 63 which is disposed coaxially with the platen roller of the tape cassette 7 is connected to the driving force transmission mechanism 16 disposed on the bottom surface 9 of the main unit 2 of the tape printing apparatus 1 and to the output gear 15 which constitutes a part of a tape movement mechanism 81.

That is, in the driving force transmission mechanism 16 and the tape movement mechanism 81, in correlation with the progress of the loading of the tape cassette 7, the driving force transmission mechanism 16 and the output gear 15 which constitutes a part of the tape movement mechanism 81 are connected to the platen drive gear 63, and the driving force of the drive motor 10 can be surely transmitted to the platen roller 60 which is rotated integrally with the platen drive gear 63 of the tape cassette 7.

When the loading of the tape cassette 7 terminates, since the elastic projection 64 formed in a substantially horseshoe shape is fitted onto the outer peripheral surface of the engagement projection 34 of the tape printing apparatus 1, the positioning of the tape cassette 7 loaded into the cassette loading section 5, and the termination of the loading of the tape cassette 7 into the cassette loading section 5 can be surely sensed bodily by the operator. Therefore, the loading of the tape cassette 7 into the cassette loading section 5 can be surely performed. The state in which the loading of the tape cassette 7 into the interior of the inner case 8 which is the cassette loading section 5 of the tape printing apparatus 1 is terminated is shown in FIG. 12.

Further, in this embodiment, the timing at which the thermal head 21 comes into contact with the platen roller 60 via the tape-shaped recording medium 6 is made to be immediately before the loading of the tape cassette 7 terminates, that is, immediately before the platen drive gear 63 disposed coaxially with the platen roller 60 is connected to the output gear 15 disposed on the bottom surface 9 of the main unit 2 of the tape printing apparatus 1. With such a construction, the tape cassette 7 is further pushed into the interior of the inner case 8 in a state in which the thermal head 21 is in contact with the platen roller 60 via the tape-shaped recording medium 6. The platen roller 60 is pushed in while rotating in a counterclockwise direction in FIG. 7 by the contact force of the thermal head 21, and the platen drive gear 63, in correlation with the rotation of the platen roller 60, is connected (fitted) to the output gear 15 while the platen drive gear 63 is rotating. When the cassette is to be loaded, damage due to the striking of mutual tooth tops (not shown) of the platen drive gear 63 and the output gear 15 is surely prevented, and the service life of the platen drive gear 63 and the output gear 15 can be surely prevented from being decreased. The loading of the tape cassette 7 into the interior of the inner case 8 which is the cassette loading section 5 of the tape printing apparatus 1 can surely be made to be smooth, and ease of operation can be surely improved.

Figure 12:
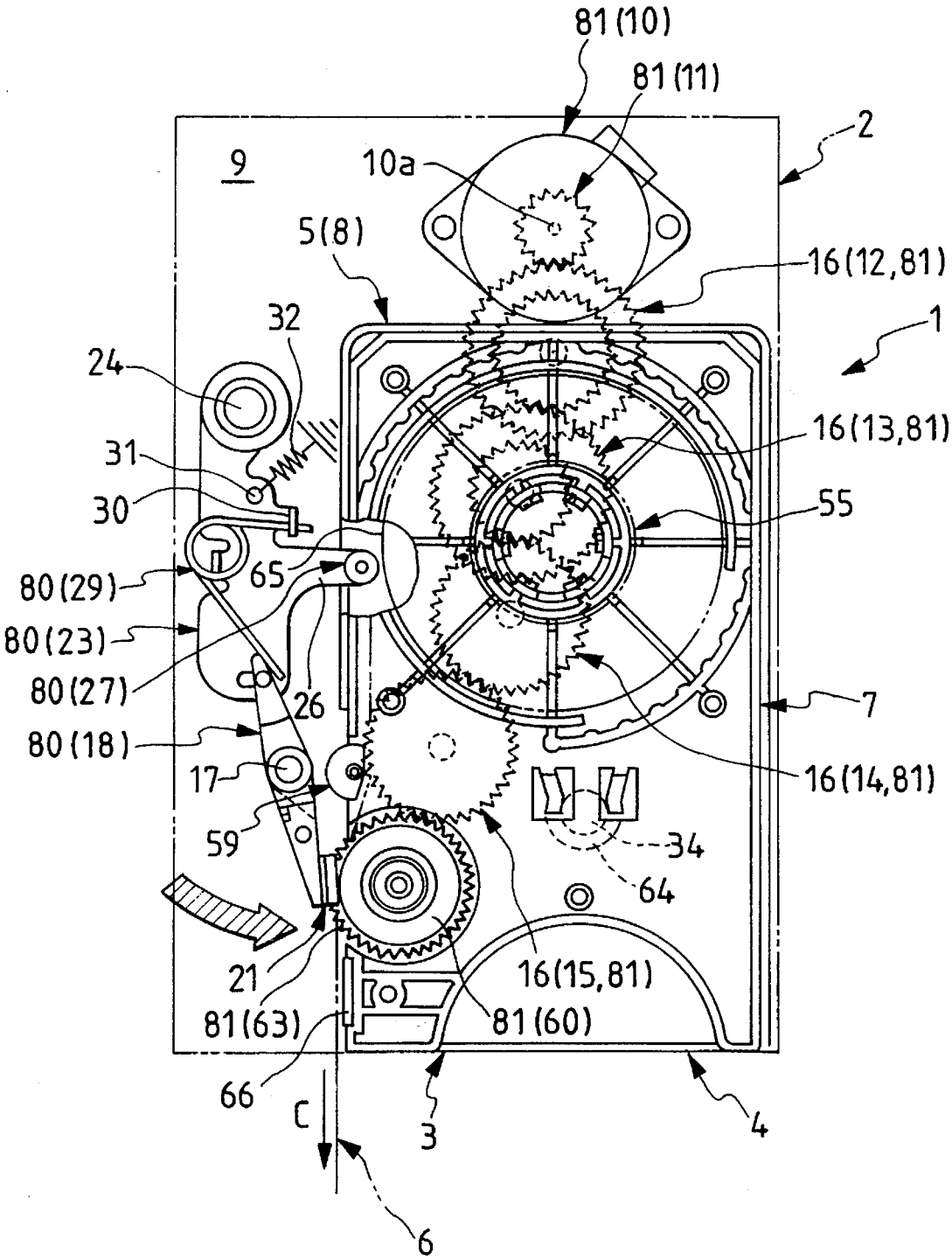
FIG. 12 is a plan view illustrating the essential portion of the interior in a state in which a tape cassette of the tape printing apparatus in accordance with the embodiment of the present invention is loaded.

Next, in a state in which the cassette is loaded, when the printing operation is started, the drive motor 10 of the tape movement mechanism 81 is driven in accordance with a control instruction from the print control section 51, the driving force of the drive motor 10 is transmitted to the platen drive gear 63 via the driving force transmission mechanism 16, the platen roller 60 is rotated integrally with the platen drive gear 63, and the tape-shaped recording medium 6 held between the thermal head 21 and the platen roller 60 is fed in the direction of the movement of the tape indicated by the arrow C in FIG. 12. As the tape-shaped recording medium 6 is moved, a plurality of heat-generating elements (not shown) of the thermal head 21 are selectively heated on the basis of print information (not shown) pre-stored in the print information storage section 50, the heat-sensitive paper 68 of the tape-shaped recording medium 6 in contact with the thermal head 21 develops color, thereby desired characters or the like are printed on the tape-shaped recording medium 6. Thereafter, when the tape-shaped recording medium 6 is fed by a predetermined length from the tape cassette 7, for example, by the length at which the tape-shaped recording medium 6 is pasted on the video cassette (not shown) in this embodiment, the printing operation terminates.

Then, the printed tape-shaped recording medium 6 which is fed from the tape cassette 7 is cut in a direction at right angles to a direction along the length of the tape-shaped recording medium 6 by operating the cutter lever 37 of the tape cutting mechanism 35. In the cut tape-shaped recording medium 6, the cut parts 71 called half cuts are formed on the releasing paper 70 at intervals narrower than the cutting length of the tape-shaped recording medium 6; therefore by bending the tape-shaped recording medium 6 toward the heat-sensitive paper 68 side at the position of the cut part 71 of the releasing paper 70, the cut part 71 of the releasing paper 70 can be easily peeled off from the adhesive layer 69 without using a tool.

Thereafter, each time the printing operation is performed, the tape-shaped recording medium 6 is fed successively from the tape cassette 7. In this embodiment, when the tape-shaped recording medium 6 which is fed successively from the tape cassette 7 comes near its end, the end display part (not shown) having a message or an end mark provided in the end of the tape-shaped recording medium 6 is exposed outside, making it possible to make the operator easily recognize that the end of the tape-shaped recording medium 6 is near, thus preventing the tape-shaped recording medium 6 from running out in the middle of the printing operation.

When the end display part (not shown) having a message or an end mark provided in the end of the tape-shaped recording medium 6 is exposed outside, the tape cassette 7, as indicated by the arrow B in FIG. 1, is taken out by pulling out the operational recessed part 67 of the tape cassette 7, and a new tape cassette 7 is loaded.

Since the upper case 52 and the lower case 53 of the tape cassette 7 can be loaded and unloaded, and, since, when the tape-shaped recording medium 6 is used up, a new tape-shaped recording medium 6 is wound around the tape reel 55 or the tape reel 55 is replaced with a new one around which a new tape-shaped recording medium 6 is wound, the economical burden can be surely reduced though much labor is required compared to a case in which the tape cassette 7 is replaced.

Therefore, according to the tape printing apparatus 1 of this embodiment, since the tape cassette 7 can be loaded and unloaded from the front side 3 side of the main unit 2 with the side of the tape cassette 7 facing the front side 3 of the main unit 2, it is possible to make the tape printing apparatus 1 to be thin such that the height of the front side 3 of the tape printing apparatus 1 is low, and it is possible to load and unload the tape cassette 7 at a small amount of an operation space. Even in a state in which the tape printing apparatus 1 is housed inside, for example, a rack, the tape cassette 7 can be easily loaded and unloaded from the tape printing apparatus 1.

Many different embodiments of the present invention may be constructed without departing from the spirit and scope of the present invention. It should be understood that the present invention is not limited to the specific embodiment described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. A tape printing apparatus for printing onto a free end of a tape-shaped recording medium, the tape-shaped recording medium being wound in a tape cassette with the free end extending from an opening formed in a wall thereof, the tape cassette including a platen roller rotatably mounted adjacent the opening and a platen drive gear fixedly connected to the platen roller, the tape printing apparatus comprising;

a main unit having a wall defining a cassette insertion slot;

a cassette loading section communicating with the cassette insertion slot for receiving the tape cassette when the tape cassette is inserted in a first direction through the cassette insertion slot;

a gear rotatably mounted in the main unit adjacent the cassette loading section, the gear being positioned to engage with the platen drive gear when the tape cassette is loaded into said cassette loading section;

a drive motor for driving the platen roller via the gear and the platen drive gear;

a head drive mechanism including a first member pivotally mounted adjacent the cassette loading section, the first member having a contact portion extending into the cassette loading section, the head drive mechanism also having a second member pivotally mounted adjacent the cassette loading section, the second member having a first portion linked to the first member and a second portion; and a print head mounted on the second portion of the second member of the head drive mechanism;

wherein when the tape cassette is inserted in the first direction into the cassette loading section, the contact portion of the first member contacts the tape cassette, thereby pivoting the first member and the second member such that the print head is brought into contact with the platen roller of said tape cassette with the free end of the tape-shaped recording medium located therebetween.

2. The tape printing apparatus according to claim 1, wherein the contact portion of the first member of the head drive mechanism is an arm having a cam follower formed on an end thereof, the cam follower being abutted against a cam part formed on an outer surface of said tape cassette.

3. The tape printing apparatus according to claim 1, wherein said head drive mechanism further comprises a resilient member to bias said print head away from the platen roller when said tape cassette is removed from said cassette loading section.

4. A tape printing apparatus comprising:

a main unit having a wall defining a cassette insertion slot;

a tape cassette inserted through the cassette insertion slot and received in the main unit, the tape cassette having a tape-shaped recording medium housed therein, the tape-shaped recording medium having a free end extending through an opening defined in an outer wall of the tape cassette, the tape cassette including a platen roller rotatably mounted adjacent the opening and a platen drive gear fixedly connected to the platen roller;

a gear rotatably mounted in the main unit and being engaged with the platen drive gear of the tape cassette;

a drive motor for rotating the platen roller via the gear and the platen drive gear;

a head drive mechanism including a head lever movably mounted adjacent the gear and having a head mounting portion, the head drive mechanism also inlcuding a cassette detection member linked to the head lever such that the head mounting portion is moved toward the platen roller when the cassette detection member detects insertion of the tape cassette into the cassette insertion slot; and a print head mounted on the head mounting portion of the second member of the head drive mechanism, the print head contacting the platen roller of said tape cassette with the free end of the tape-shaped recording medium located therebetween;

wherein the print head and platen roller are located adjacent the cassette insertion slot; and wherein the free end of the tape-shaped recording medium extends through the cassette insertion slot of the main unit.

5. The tape printing apparatus according to claim 4, wherein the contact portion of the first member of the head drive mechanism is an arm having a cam follower formed on an end thereof, the cam follower being abutted against a cam part formed on an outer surface of said tape cassette.

6. The tape printing apparatus according to claim 4, wherein said head drive mechanism further comprises a resilient member for biasing said print head away from the platen roller when said tape cassette is removed from said main unit.

7. A video tape recorder including a tape printing apparatus mounted therein for printing onto a free end of a tape-shaped recording medium, the tape-shaped recording medium being wound in a tape cassette with the free end extending from an opening formed in a wall thereof, the tape cassette including a platen roller rotatably mounted adjacent the opening and a platen drive gear fixedly connected to the platen roller, the video tape recorder comprising:

a main unit having a wall defining a cassette insertion slot;

a cassette loading section communicating with the cassette insertion slot for receiving the tape cassette when the tape cassette is inserted in a first direction through the cassette insertion slot;

a gear rotatably mounted in the main unit adjacent the cassette loading section, the gear being positioned to engage with the platen drive gear when the tape cassette is loaded into said cassette loading section;

a drive motor for driving the platen roller via the gear and the platen drive gear;

a head drive mechanism including a first member pivotally mounted adjacent the cassette loading section, the first member having a contact portion extending into the cassette loading section, the head drive mechanism also having a second member pivotally mounted adjacent the cassette loading section, the second member having a first portion linked to the first member and a second portion; and a print head mounted on the second portion of the second member of the head drive mechanism;

wherein when the tape cassette is inserted in the first direction into the cassette loading section, the contact portion of the first member contacts the tape cassette, thereby pivoting the first member and the second member such that the print head is brought into contact with the platen roller of said tape cassette with the free end of the tape-shaped recording medium located therebetween.

8. The video tape recorder according to claim 7, wherein the contact portion of the first member of the head drive mechanism is an arm having a cam follower formed on an end thereof, the cam follower being abutted against a cam part formed on an outer surface of said tape cassette.

9. The video tape according to claim 7, wherein said head drive mechanism further comprises a resilient member for biasing said print head away from the platen roller when said tape cassette is removed from said main unit.

* * * * *